US006205976B1

(12) United States Patent
Schmidt et al.

(10) Patent No.: US 6,205,976 B1
(45) **Date of Patent: *Mar. 27, 2001**

(54) METHOD AND ARRANGEMENT FOR CONTROLLING AN OPERATING VARIABLE OF A MOTOR VEHICLE

(75) Inventors: Henning Schmidt, Schwieberdingen; Diethard Loehr, Holzmaden, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/514,317

(22) Filed: Feb. 28, 2000

Related U.S. Application Data

(63) Continuation of application No. 09/152,461, filed on Sep. 14, 1998.

(30) Foreign Application Priority Data

Sep. 12, 1997 (DE) ..... 197 40 186

(51) Int. Cl.[7] ..... F02D 41/00

(52) U.S. Cl. ..... 123/350; 123/357; 123/361

(58) Field of Search ..... 123/350, 361, 123/357, 399, 396, 339.19, 339.2, 339.21, 352, 353, 354, 355, 358, 356, 696; 701/109, 106

(56) References Cited

U.S. PATENT DOCUMENTS

| | | | |
|---|---|---|---|
| 4,441,471 | 4/1984 | Kratt et al. | 123/339 |
| 5,048,482 | 9/1991 | Kratt et al. | 123/333 |
| 5,144,915 | 9/1992 | Grabs | 123/683 |
| 5,233,958 | 8/1993 | Knoss et al. | 123/396 |
| 5,293,852 | 3/1994 | Lehner et al. | 123/339 |
| 5,370,094 | 12/1994 | Sorg et al. | 123/339 |

*Primary Examiner*—Henry C. Yuen
*Assistant Examiner*—Mahmoud M Gimie
(74) *Attorney, Agent, or Firm*—Walter Ottesen

(57) ABSTRACT

The invention is directed to a method and an arrangement for controlling an operating variable of a motor vehicle wherein the controller has at least one changeable parameter. This parameter of the controller is changed in dependence upon the operating range of the actuator, which is driven by the controller, and/or the magnitude of the change of the desired value.

10 Claims, 3 Drawing Sheets

METHOD AND ARRANGEMENT FOR CONTROLLING AN OPERATING VARIABLE OF A MOTOR VEHICLE

This is a continuation of application Ser. No 09/152,461, filed Sep. 14, 1998.

BACKGROUND OF THE INVENTION

In modern controls for motor vehicles and especially for drive units, controllers are often utilized which actuate an actuator in dependence upon the deviation between a pregiven desired value and an actual value of the operating value to be controlled. This actuation is in the sense of bringing the operating variable close to the desired value. Examples of such controllers are controllers for controlling the idle rpm, for controlling the position of a throttle flap, for controlling or limiting the road speed, et cetera. These controllers include controller constants, such as proportional constants, integral constants and/or differential constants whose magnitudes are determined in advance with a view toward the desired stability and dynamic of the control operation. It has been shown that a single set of the above-mentioned variables is not sufficient in all areas of application for a satisfactory control over the entire operating range of the controller. This applies especially to the application of actuators having a large nonlinearity.

One example of an actuator having a large nonlinearity is known from U.S. Pat. No. 4,947,815. The throttle flap actuator described therein includes an emergency air position pregiven by springs. That is, the emergency air position is that position which the throttle flap assumes when no power is supplied to the electric motor driving the throttle flap. If this emergency air position is to be passed through, the sign of the drive torque of the actuator motor reverses. This nonlinearity of the actuator element leads to the condition that a compromise for the determination of the parameter set for the controller is achieved only with difficulty. The control performance is therefore not satisfactory in all operating situations.

A PID position controller is disclosed in German patent publication 4,223,253 which is operated with different sets of parameters in order to achieve a different dynamic in various operating modes such as idle control, drive slip control, et cetera. Operation is with fixed parameter sets within individual operating phases so that the above-mentioned problems occur when driving an actuator which is very nonlinear.

U.S. Pat. No. 4,441,471 discloses an example of an idle rpm control wherein the control parameters are pregiven in dependence upon the difference between the desired and actual values.

SUMMARY OF THE INVENTION

It is an object of the invention to improve the control performance of a control loop for an operating variable of a motor vehicle.

The method of the invention is for controlling an operating variable of a motor vehicle which includes an actuator and a controller for forming a drive signal to drive the actuator. The controller has at least one changeable parameter and the actuator has an operating range subdivided into at least first and second operating subranges. The method includes the steps of: providing a desired value of the operating variable and the desired value being change able; detecting an actual value of the operating variable; forming the drive signal in dependence upon the desired value and the actual value; and, changing the at least one parameter of the controller in dependence upon at least one of the following: the particular operating subrarge of the actuator and the magnitude of the change of the desired value.

The control performance of the control loop is improved because different, optimally adapted parameter sets of the control parameters are pregiven depending upon the operating range of the actuator which is part of an actuator assembly which includes, for example, the actuator in the form of an electric motor and a positioning element such as a throttle flap driven by the electric motor. In this way, a nonlinearity, which is present in the actuator, is considered in an advantageous manner via a corresponding selection of the controller parameters whereby, in each operating range, an optimization of the control performance can take place.

It is further especially advantageous that a change of the controller parameters is carried out in dependence upon the magnitude of the change of the desired value of the control loop. In this way, the dynamic of the control loop can be optimally adapted and the complexity of the application is greatly reduced especially with respect to the comparison to the dependency of the parameters from the desired value/actual value deviation. This is so because the parameter switchover only concerns specific jumps in the desired value. The parameters can be adapted optimally to the particular situation. Furthermore, the parameters remain constant during the jump of the desired value. The stability of the control loop is thereby significantly improved.

BRIEF DESCRIPTION OF THE DRAWINGS

The invention will now be explained with reference to the drawings wherein.

DESCRIPTION OF THE PREFERRED EMBODIMENTS OF THE INVENTION

In the following, the invention will be described with respect to a digital position control loop which adjusts the throttle flap of an internal combustion engine while using a PID controller. The described procedure is, however, used in other embodiments in combination with other controller types (for example, PI controllers, PD controllers, I controllers, et cetera), other control loops (for example, rpm control loops, load control loops, torque control loops, road speed control loops, et cetera) and/or other actuators.

Figure 1:
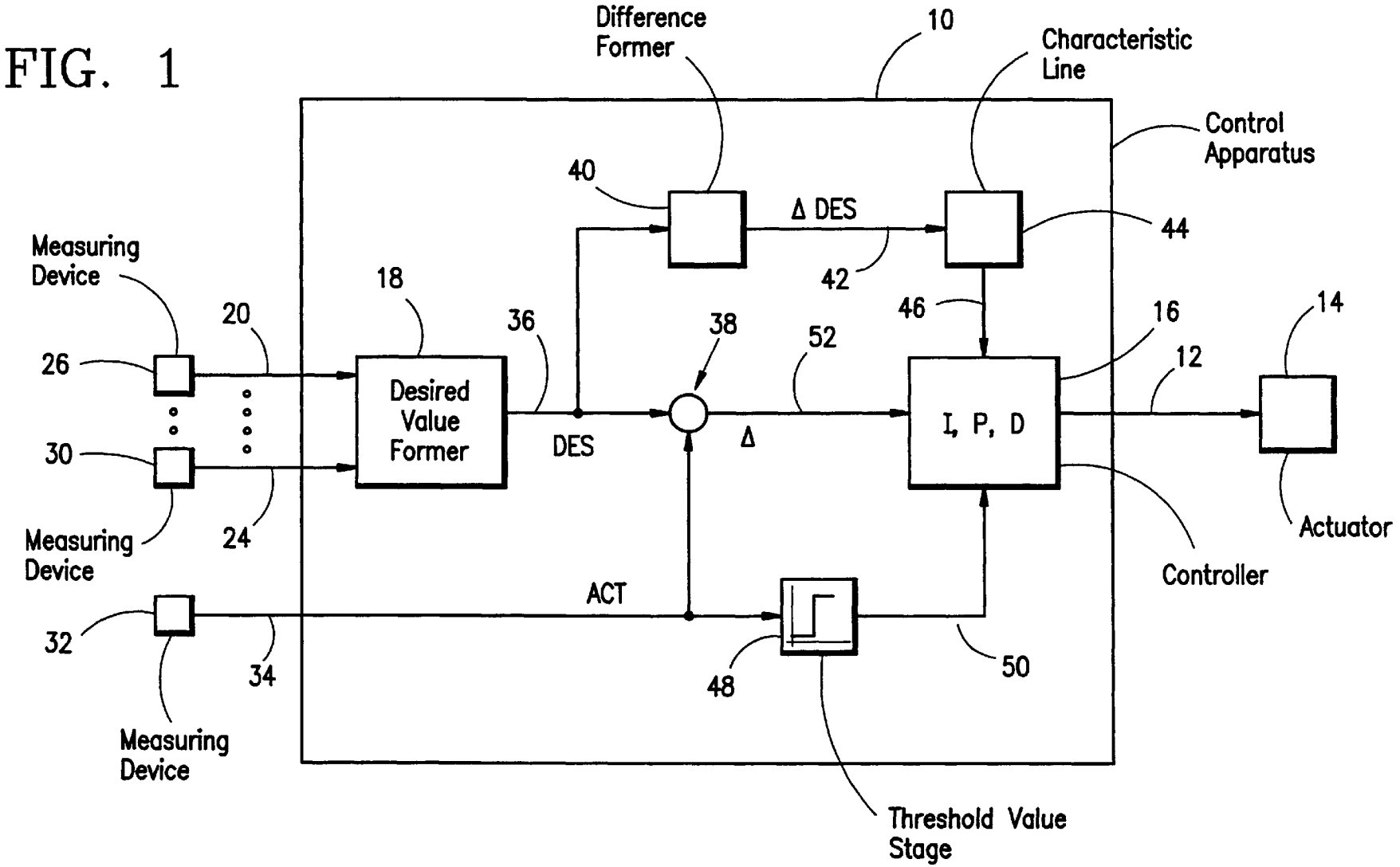
FIG. 1 shows an overview block circuit diagram of a control loop.

FIG. 1 is an overview block circuit diagram of a control loop for the control of an operating variable of a vehicle with respect to an example of a position control of a throttle flap of an internal combustion engine. A control unit 10 controls an actuator 14 for a throttle flap (not shown) via an output line 12. The actuator 14 exhibits large nonlinearities over its positioning range as known from the state of the art.

The control unit 10 preferably includes a microcomputer wherein the elements described below are realized as programs. A controller 16 is provided in the control apparatus 10. The controller 16 has a PID characteristic in the preferred embodiment. In other embodiments, one or two components of the controller 16 are not needed.

Furthermore, a desired-value former 18 is provided to which operating variables are supplied via lines 20 to 24 from measuring devices 26 to 30, respectively, which are applied for the formation of the desired value. These operating variables are, for example, accelerator pedal position, engine temperature, engine rpm, et cetera. Furthermore, a measuring device 32 is provided for detecting the actual value of the control which supplies its measurement quantity ACT via the line 34 to the control apparatus 10. In the preferred embodiment, the measuring device 32 detects the position of the actuator 14, that is, the throttle flap.

The output quantity DES of the desired-value former 18 is supplied via the output line 36 to a comparator element 38 and to a difference former 40. The desired value change ΔDES is determined in the difference former 40. This desired value change ΔDES is supplied via a line 42 to a threshold value stage or a characteristic line 44. The output quantity of the characteristic line 44 is outputted via line 46 and influences the control parameters of the controller 16. The actual variable of the control loop is, on the one hand, supplied to the comparator element 38 while, on the other hand, to a threshold value stage 48. The output line 50 of the threshold value stage 48 leads to the controller 16. The controller parameters are determined in dependence upon the output of the threshold value stage 48. The comparator element 38 forms the control deviation Δ in dependence upon the desired and actual values. The control deviation Δ is supplied via the line 52 to the controller 16.

The desired value former 18 forms the desired value DES for the operating variable on the basis of characteristic lines, characteristic fields, tables and/or computations in dependence upon the input quantities thereof. The desired value DES is compared in the comparator element 38 to the measured actual value and the control deviation Δ is formed in this manner. The controller 16 forms a drive signal on the basis of this control deviation and its pregiven parameters. The drive signal is outputted via the line 12 to actuate the actuator 14. When using a nonlinear actuator (especially an actuator described in the state of the art mentioned above and which exhibits essentially two operating ranges), the control with a single set of parameters for the controller 16 is not satisfactory. For this reason, different parameter sets, which are adapted optimally for this operating range, are used in dependence upon the particular operating range of the actuator.

Two operating ranges are to be distinguished when utilizing an actuator of the kind described in the state of the art initially mentioned herein, namely, the operating range below the emergency air point and the range above the emergency air point. The particular operating range is selected in dependence upon the position of the actuator as to whether this position is greater or less than the emergency air position. For each of these ranges, a set of controller parameters is provided, that is, pregiven values for the parameters P, I and/or D are provided which are then read in by the controller 16 when there is a changeover into the corresponding operating range. In this way, the controller is optimally adapted to the different operating ranges of the actuator so that the nonlinearity of the actuator has no disadvantageous effects on the control performance. The threshold value switch 48 for the switchover is symbolically shown in FIG. 1 and is burdened with hysteresis in an advantageous embodiment.

As a supplement or as an alternative measure, it is provided to pregive, with a change of the desired value, the parameter set of the controller in dependence upon the magnitude of this change and to maintain this parameter set constant until the next desired value change. This procedure is utilized also within an operating range of the actuator. For this purpose, the desired value DES is compared to a previous desired value. If a difference ΔDES is detected, then the set of parameters assigned to this desired value change is read out and read in by the controller 16. The determination of the desired value change can also be realized as a differentiation of the desired value. For the determination of the parameters, which are dependent upon the change of the desired quantity, an allocation of the parameters as a characteristic line is utilized in one embodiment. In this embodiment, a characteristic line is provided for each parameter or for selected parameters. The characteristic line defines the value of this parameter in dependence upon the change of the desired value.

Figure 2:
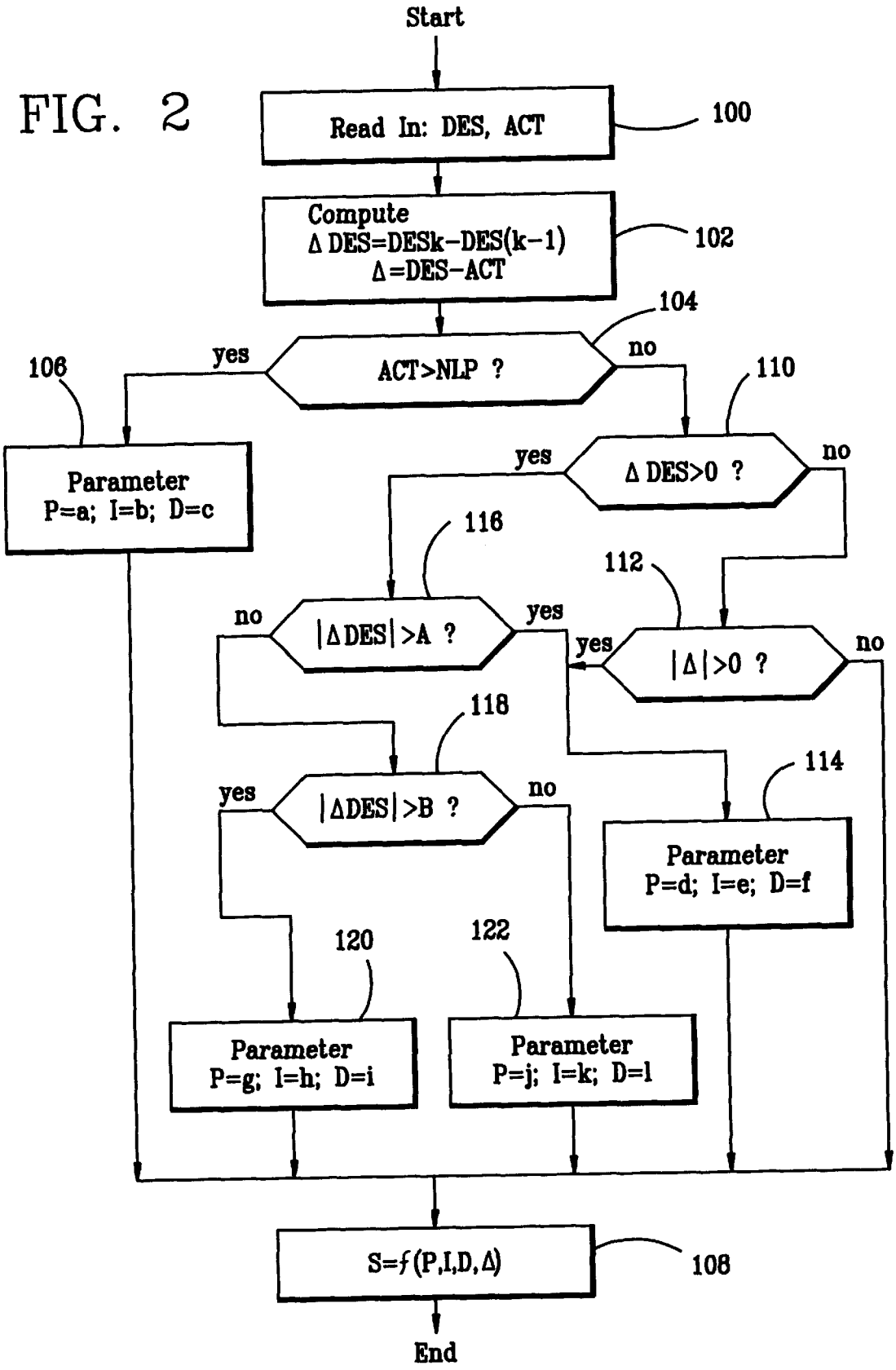
FIG. 2 is a preferred embodiment of the invention shown with respect to a flowchart; and, FIGS. 3*a* and 3*b* show the dependency of the control parameters on the operating range of the actuator and/or on the magnitude of the change of the desired value of the control loop.
Figure 3A:
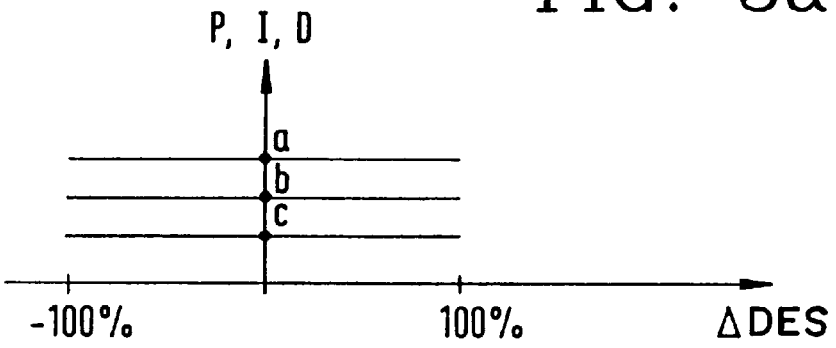
Figure 3B:
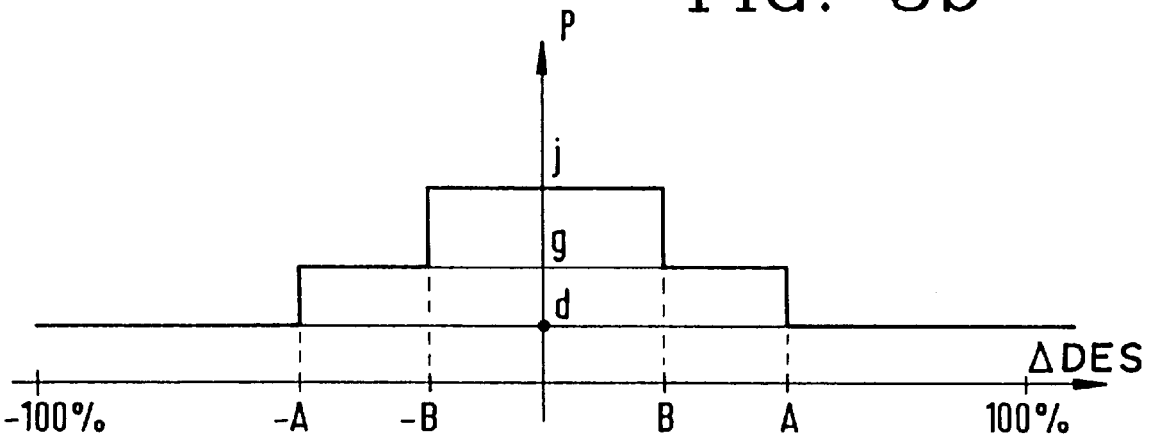

Another advantageous embodiment is shown in FIGS. 2, 3*a* and 3*b*. In this embodiment, fixed parameter sets are pregiven for specific ranges of the desired value change. In this case, the particular range of the desired value change is determined by means of a comparison with threshold values and the set of parameters, which is provided for this range, is read in by the controller 16.

In an advantageous supplement, it is provided that, for a constant desired value and for a control deviation occurring because of an external disturbance, which exceeds a pregiven threshold value, the actual parameter set of the controller is reset to the standard parameter set provided for this operating range. In this way, a stable controlling out of the control deviation, which occurs because of an external disturbance, is ensured.

The trace of the controller output quantity can possibly be uneven because of the switchover. In an advantageous embodiment, the controller output quantity is smoothed, for example, in that the output quantity is guided during the switchover via a filter function from the old value to the new value.

FIG. 2 shows a preferred embodiment wherein the controller parameters are changed in dependence upon the operating range as well as in dependence upon the change of the desired value. In the preferred embodiment, the above-mentioned procedure is realized as a program of the microcomputer of the control apparatus 10. Such a program is shown as a flowchart in FIG. 2.

After start at pregiven time intervals, in the first step 100, desired value DES and actual value ACT are read in. In the next step 102, the desired value change ΔDES is computed from the actual desired value DESk and a previous desired value DES(k–i). Furthermore, the control deviation Δ is formed by the formation of the difference between the desired and actual values. In the next inquiry step 104, the actual value is compared to the position value of the emergency air point NLP. If the actuator is in an operating range above the emergency air point, that is, if the actual value is greater than the position value at the emergency air point, then the standard parameter set is read in for this operating range in accordance with step 106. Here, the parameter P has the value a, I the value b and D the value c. This is shown in FIG. 3*a* wherein the parameters P, I and D are plotted as a function of the change ΔDES of the desired value.

In the preferred embodiment, it is provided that, in this operating range, no dependency on the desired value change should be present. This means that, over the entire range of the desired value change, the parameters have the same pregiven value. In other embodiments, the dependency (defined as shown in the other operating range) on the desired value change is pregiven also in this operating range.

After step 106, the drive signal value S is computed in step 108 in dependence upon the control deviation Δ as well as in dependence on the particular loaded or read-in parameters P, I and/or D by the controller. This computation is made in the sense of a reduction of the control deviation. The drive signal value S is then outputted. The program is ended and repeated at the next time point with step 100.

In step 104, the inquiry was carried out, if required, while considering a hysteresis. If it results in step 104 that the actual value is not greater than the emergency air point value (that is, that the actuator is disposed below the emergency air point), the program moves to inquiry step 110. There, a check is made as to whether a desired value change is present. If this is not the case, a check is made in step 112 as to whether the amount of the control deviation Δ has exceeded a predetermined limit value Δ0. If this is not the case, then nothing is changed in the existing situation and the actuating variable is computed in accordance with step 108 on the basis of the actual parameters. However, if step 112 shows that the control deviation exceeds the limit value Δ0, then, according to step 114, the standard parameter values d, e and f are read in and the actuating variable is computed according to step 108 on the basis of these standard parameters. The standard parameter values d, e and f are provided for this operating range.

If it is determined in step 110 that a desired value change has taken place, then in the next inquiry step 116, the amount of the desired value change is compared to a first threshold value A. If the amount of the desired value change exceeds the value A, then the standard parameters according to step 114 are set. If the amount of the desired value change drops below the value A then, in step 118, a check is made as to whether the amount of the desired value change exceeds the value B. In this case, and according to step 120, a first parameter set is read in and in the opposite case, a second parameter set is read in in accordance with step 122.

In FIG. 3*b,* the different parameter quantities are shown in dependence upon the desired value change ΔDES based on the proportional component. Here, the desired value change ΔDES is plotted horizontally with the threshold values A and B; whereas, the particular magnitudes of the parameters in the particular desired value change range are shown. The parameter is then greater the smaller the desired magnitude change is. In this way, the dynamic is considerably improved especially for small value changes.

The change of the parameter set can affect all control parameters of the controller. In other embodiments, only selected control parameters are correspondingly changed, for example, only the P component or only the I component.

It is understood that the foregoing description is that of the preferred embodiments of the invention and that various changes and modifications may be made thereto without departing from the spirit and scope of the invention as defined in the appended claims.

What is claimed is:

1. A method for controlling an operating variable of a motor vehicle which includes an actuator and a controller for driving said actuator in a control loop having an operating range, said controller having at least one changeable parameter (P, I, D), the method comprising the steps of:

forming a changeable desired value (DES) for said operating variable;

detecting an actual value (ACT) of said operating variable;

subdividing said operating range into first and second subranges;

determining at least one of said subranges in dependence upon at least one of the following: the magnitude of said actual value (ACT) and a magnitude of a change (ΔDES) of said changeable desired value (DES);

determining the value of said at least one parameter (P, I, D) in dependence upon the determined subrange; and, forming a drive signal (S) in dependence upon said desired value (DES), said actual value (ACT) and said at least one parameter (P, I, D) of said controller.

2. The method of claim 1, wherein said actuator drives a throttle flap of an internal combustion engine and said operating variable is the position of said throttle flap.

3. The method of claim 2, wherein said throttle flap has a mechanically set emergency air position; and, said first operating subrange being below said emergency air position and said second operating subrange being above said emergency air position.

4. The method of claim 1, wherein the method comprises the further step of distinguishing said operating subranges based on said actual value of said operating variable.

5. The method of claim 1, comprising the further steps of:

determining the change in said desired value; and, comparing said change to pregiven threshold values and said at least one parameter having a different value depending upon the range of said change of said desired value.

6. The method of claim 1, comprising the further step of providing a characteristic line wherein said at least one parameter of said controller is stored in dependence upon the change of said desired value.

7. The method of claim 4, wherein the dependency of the change of said desired value takes place in at least one of said operating subranges of said control loop.

8. The method of claim 1, comprising the further step of setting said at least one changeable parameter to a standard value when the magnitude of said change of said desired value is constant and the control deviation changes.

9. The method of claim 4, wherein the dependency on the change in said desired value takes place only in one of said operating subranges of said control loop.

10. An arrangement for controlling an operating variable of a motor vehicle, the arrangement comprising:

an electrically actuable actuator;

a controller for driving said actuator in the context of a control loop having an operating range subdivided into first and second subranges and said controller having at least one changeable parameter (P, I, D);

means for forming a desired value (DES) for said operating variable;

means for detecting an actual value (ACT) of said operating variable;

means for determining at least one of said subranges in dependence upon at least one of the following: the magnitude of said actual value (ACT) and a magnitude of a change (ΔDES) of said changeable desired value (DES);

means for determining the value of said at least one parameter (P, I, D) in dependence upon the determined subrange; and, said controller generating a drive signal (S) in dependence upon said desired value (DES), said actual value (ACT) and said at least one parameter (P, I, D) of said controller for driving said actuator.

* * * * *